US006862773B2

(12) United States Patent
Park et al.

(10) Patent No.: US 6,862,773 B2
(45) Date of Patent: Mar. 8, 2005

(54) DUST COVER SEALING APPARATUS FOR A VACUUM CLEANER

(75) Inventors: Jung-seon Park, Gwangju (KR); Iil-won Yang, Gwangju (KR); Hyung-il Jeon, Gwangju (KR)

(73) Assignee: Samsung Gwangju Electronics Co. Ltd., Gwangju (KR)

( * ) Notice: Subject to any disclaimer, the term of this patent is extended or adjusted under 35 U.S.C. 154(b) by 366 days.

(21) Appl. No.: 10/208,278

(22) Filed: Jul. 30, 2002

(65) Prior Publication Data

US 2003/0140447 A1 Jul. 31, 2003

(30) Foreign Application Priority Data

Jan. 31, 2002 (KR) ..... 2002-5528

(51) Int. Cl.[7] ..... A47L 5/28; A47L 9/14

(52) U.S. Cl. ..... 15/351

(58) Field of Search ..... 15/327.1, 327.2, 15/327.6, 327.7, 350, 351, 352

(56) References Cited

FOREIGN PATENT DOCUMENTS

| | | | |
|---|---|---|---|
| CZ | 278466 | * | 1/1994 |
| DE | 2902631 | * | 8/1979 |
| FR | 2447176 | * | 9/1980 |
| GB | 2265096 | * | 9/1993 |
| JP | 5253131 | | 10/1993 |
| JP | 10127538 | | 5/1998 |

* cited by examiner

*Primary Examiner*—Terrence R. Till
(74) *Attorney, Agent, or Firm*—Ladas & Parry LLP

(57) ABSTRACT

A dust cover sealing apparatus of a vacuum cleaner comprises a first fence protruding from an edge of a dust collecting chamber and having a predetermine height, and a second fence protruding from an inner surface of the dust cover to contact an end of the first fence when the dust cover is mounted on a cleaner body, and a plurality of guide ribs protruding from an inner surface of the dust cover adjacent to a side of the second fence, for guiding the second fence so that ends of the first and second fences contact each other when the dust, cover is mounted on the cleaner body. Accordingly, the sealing efficiency of the dust collecting chamber is maintained, and the manufacturing cost is reduced.

4 Claims, 4 Drawing Sheets

DUST COVER SEALING APPARATUS FOR A VACUUM CLEANER

BACKGROUND OF THE INVENTION

1. Field of the Invention

The present invention generally relates to a vacuum cleaner, and more particularly, to a dust cover sealing apparatus which is removably mounted in a side of a vacuum cleaner body for sealing a dust collecting chamber.

2. Description of the Related Art

Generally, a vacuum cleaner includes a suction motor mounted in a suction motor driving chamber, a cleaner body comprising a dust collecting apparatus disposed in a dust collecting chamber, and a suction port assembly for drawing in dust-laden air therethrough with a suction force generated at the cleaner body when the suction motor is driven.

FIG. 1 shows an example of a conventional upright type vacuum cleaner. Referring to FIG. 1, an upright type vacuum cleaner 100 includes a suction port assembly 130 for drawing in dirt from a surface to be cleaned and a cleaner body 120 pivotally connected to the suction port assembly 130. The cleaner body 120 is divided into a suction fan driving chamber (not shown) and a dust collecting chamber 125. The dust collecting chamber 125 is in fluid communication with the suction port assembly 130 through an air suction pipe 128 and is in fluid communication with the suction fan driving chamber through an air suction grill 127.

The dust collecting chamber 125 has an open side and is sealed by a dust cover 140 mounted on the cleaner body 120. As is also shown in the cross-sectional view of FIG. 2, the cleaner body 120 is provided with a fence 123 protruding from an edge of the dust collecting chamber 125, and the dust cover 140 is provided with a receiving recess 143 formed on an inner surface thereof to receive the fence 123. The dust cover 140 is mounted on the dust collecting chamber 125, with an end of the fence 123 being inserted into the receiving recess 143, thereby sealing the dust collection chamber 125.

Generally, the fence 123 and the receiving recess 143 are integrally formed with the cleaner body 120 and the dust cover 140, respectively. However, since the fence 123 and the receiving recess 143 are deformed due to various errors in manufacturing the fence 123 and the receiving recess 143, it is difficult for the fence 123 to be precisely and accurately fitted into the receiving recess 143. In order to solve this problem, the receiving recess 143 is formed to have a larger width than the lateral thickness of the fence 123. Since the fence 123 is loosely inserted into the receiving recess 143, the sealing efficiency of the dust cover 140 deteriorates.

In order to solve the above problem, the vacuum cleaner 100 additionally includes a packing portion 160 (FIG. 2) made of rubber material, which is disposed between the receiving recess 143 and the fence 123. The packing portion 160 is usually mounted in the receiving recess 143 to be removable therefrom. The packing portion 160 is force-pressed by the fence 123 when removing members 149*a* and 149*b*, which are provided at an upper end and a lower end of the dust cover 140, are inserted into corresponding mounting recesses 129*a* and 129*b*, which are formed in the cleaner body 120. Accordingly, the dust collecting chamber 125 is sealed in a manner such that an end of the fence 123 pressingly engages the packing portion 160.

However, in the conventional vacuum cleaner 100, constructed in accordance with the above description, the packing portion 160 is required to be disposed on the receiving recess 143 of the dust cover 140, thereby causing manufacturing costs to increase.

SUMMARY OF THE INVENTION

The present invention has been developed to solve the above problem. Accordingly, it is an object of the present invention to provide a dust cover sealing apparatus for a vacuum cleaner that decreases the manufacturing costs by omitting the use of a separate and extra packing portion.

In order to achieve the above object, the dust cover sealing apparatus of an vacuum cleaner according to the present invention comprises a first fence protruding from an edge of an open side of a dust collecting chamber which is disposed inside the vacuum cleaner, the first fence having a predetermined height, and a receiving portion formed on an inner surface of a dust cover that is mounted on a cleaner body for covering the open side of the dust collecting chamber, the receiving portion being provided to receive the first fence. The receiving portion further comprises a second fence protruding from the inner surface of the dust cover, with an end surface pressingly contacting an end surface of the first fence so as to seal the dust collecting chamber, and a plurality of guide ribs protruding from an inner surface of the dust cover adjacent to a side of the second fence toward the first fence, for guiding the second fence so that ends of the first and second fences contact each other when the dust cover is mounted on the cleaner body.

According to the preferred embodiment of the present invention, it is preferred that the guide ribs comprise a plurality of first guide ribs and second guide ribs arranged along opposed sides along the outer and inner circumference of the second fence.

Also, the first and second guide ribs are spaced apart from each other by a predetermined distance.

Also, the first and second guide ribs are arranged in an alternating arrangement, being opposed to each other with respect to the second fence. Accordingly, when the dust cover is mounted on the cleaner body, the two opposing sides of the first fence are supported on an inner surface of the first and second guide ribs alternately.

Furthermore, the distance between lower ends of the first and second guide ribs is the same as the thickness of the first fence, when viewed from a vertical direction. Also, the first and second guide ribs preferably have slanted surfaces formed on the respective upper ends thereof, such that the distance between the first and second guide ribs becomes increasingly wider towards the upward ends thereof, when viewed from a vertical direction.

BRIEF DESCRIPTION OF THE DRAWINGS

The above objects and characteristics of the present invention will be more apparent by describing a preferred embodiment of the present invention in greater detail with reference to the accompanying drawings, in which.

DETAILED DESCRIPTION OF THE PREFERRED EMBODIMENT

Figure 1:
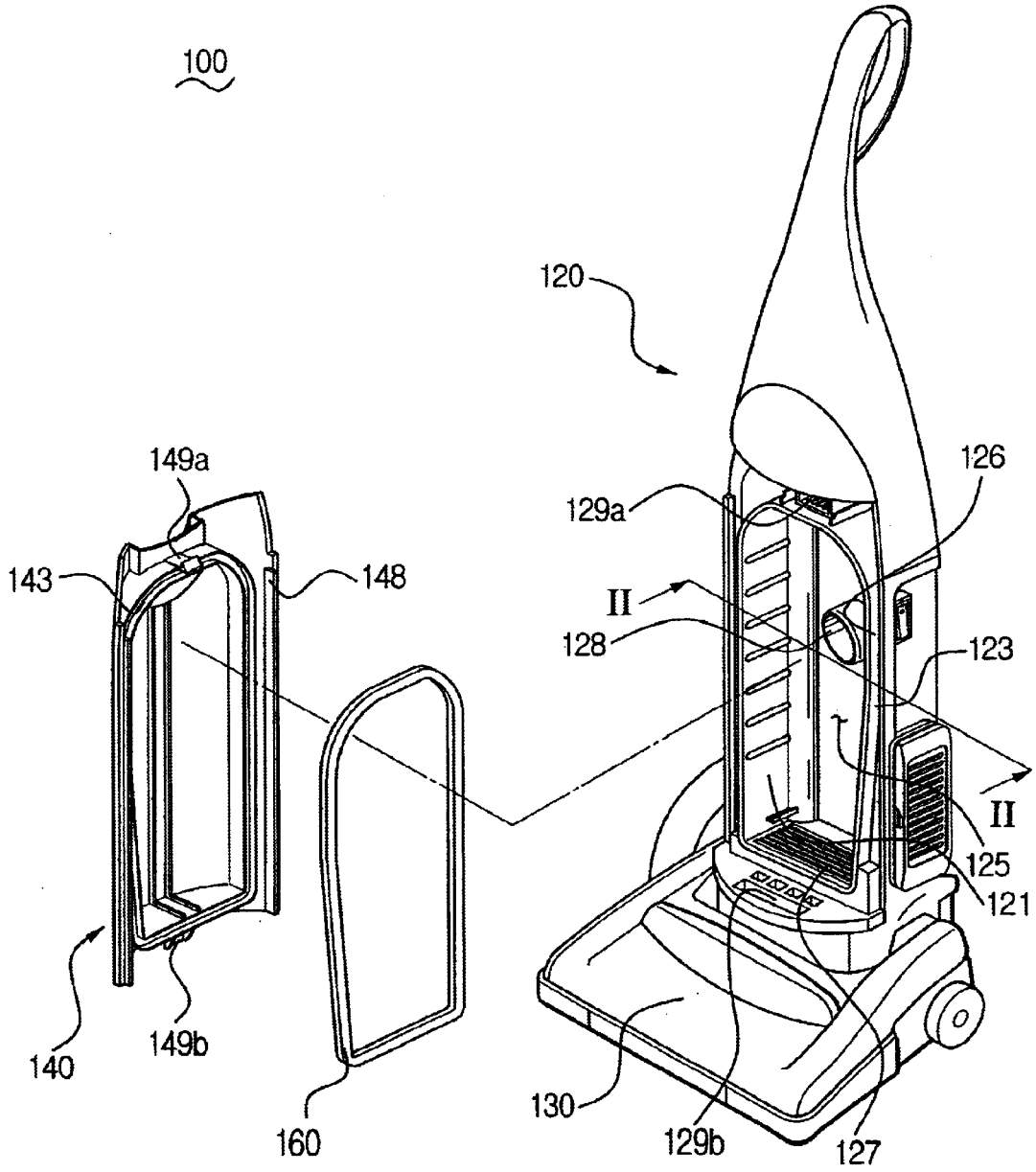
FIG. 1 (PRIOR ART)
FIG. 1 is an exploded perspective view showing a conventional upright type vacuum cleaner.
Figure 2:
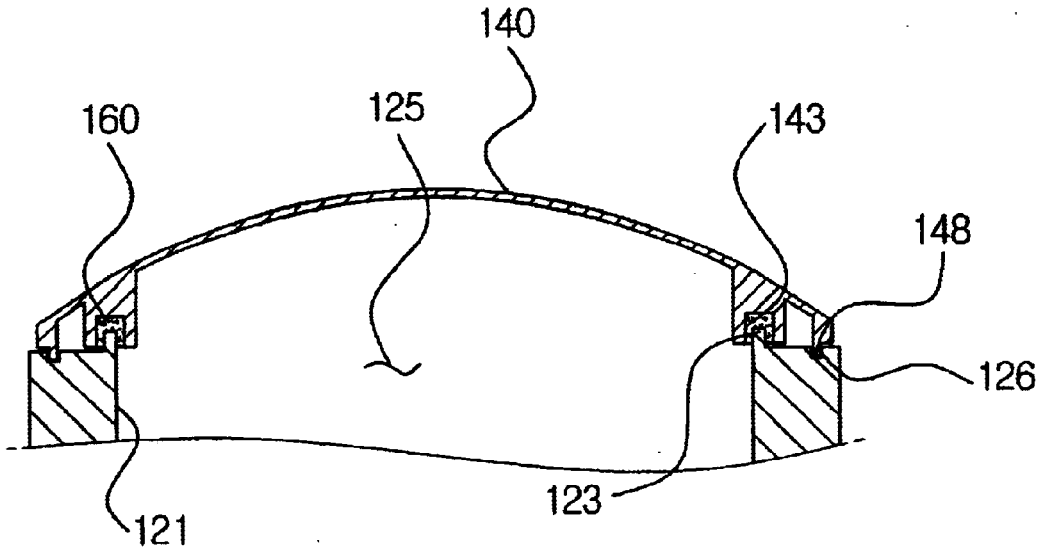
FIG.2 (PRIOR ART)
FIG. 2 is a cross-sectional view taken approximately along lines II—II of FIG. 1, showing the dust cover mounted on the conventional upright type vacuum cleaner of FIG. 1 in an assembled state.

Hereinafter, a preferred embodiment of the present invention will be described in greater detail, with reference to the accompanying drawings. With respect to the components which have like constructions and functions with those of the conventional upright type vacuum cleaner described in FIGS. 1 and 2, identical reference numerals will be used.

Figure 3:
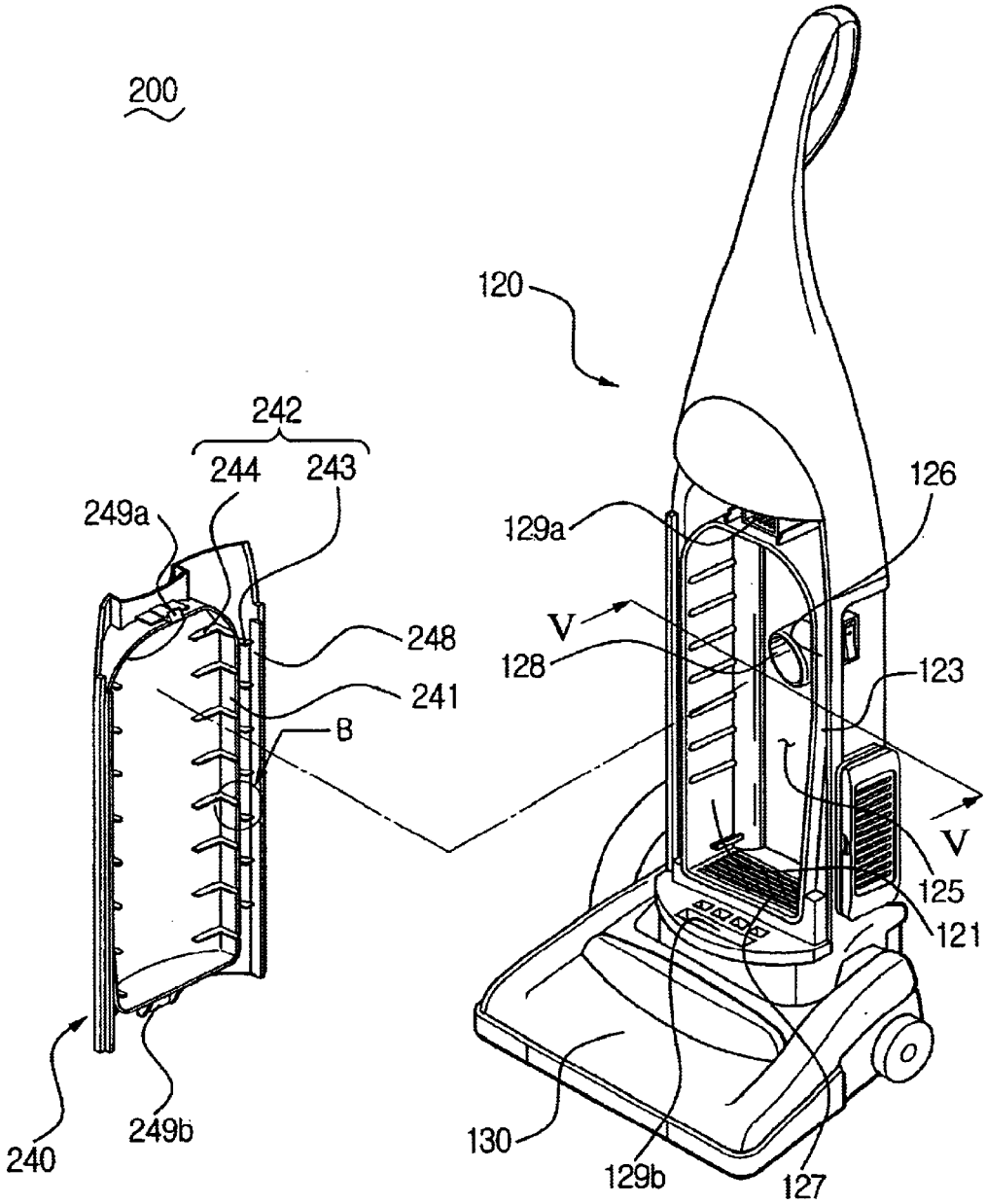
FIG. 3 is an exploded perspective view showing an upright type vacuum cleaner according to the present invention.

As shown in FIG. 3, according to the preferred embodiment of the present invention, a vacuum cleaner 200 includes a cleaner body 120 having a dust collecting chamber 125 formed therein, which has an open side, and a dust cover 240, removably mounted on the cleaner body 120, for sealing the dust collecting chamber 125. An air suction pipe 128 provides a means for fluid communication of the dust collecting chamber 125 with a suction port assembly 130, and the reference numeral 127 indicates an air suction grill through which the dust collecting chamber 125 is in fluid communication with the suction motor driving chamber (not shown).

The cleaner body 120 comprises a first fence 123, which protrudes from an edge of the dust collecting chamber 125 to a predetermine height within the cleaner body 120. That is, the first fence 123 extends from an inner wall 121, which partitions the dust collecting chamber 125 from the cleaner body 120.

Figure 4:
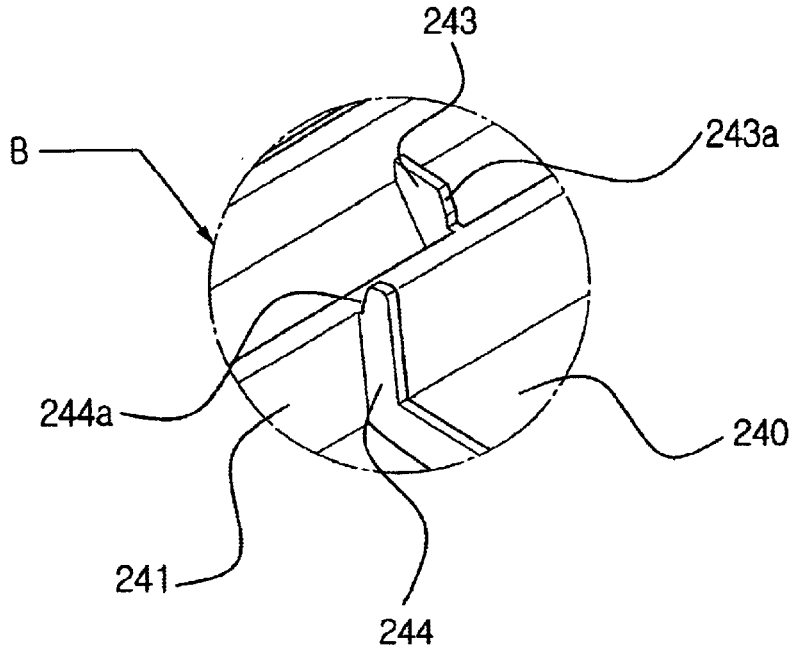
FIG. 4 is a perspective view showing in an enlarged detail view the section within the circle labeled "B" in FIG. 3.

Referring to FIGS. 3 and 4, the dust cover 240 includes a second fence 241 protruding from an inner side of the dust cover 240, and a plurality of guide ribs 242. When the dust cover 240 is mounted on the cleaner body 120, the second fence 241 and the guide ribs 242 receive the first fence 123, and an end of the second fence 241 contacts an end of the first fence 123. With the respective ends of the first and second fences 123 and 241 pressingly contacting each other, the removing members 249*a* and 249*b*, respectively disposed on an upper side and a lower side of the dust cover 240, are inserted into the mounting recesses 129*a* and 129*b* formed in the cleaner body 120 so that the dust cover 240 seals the dust collecting chamber 125. Furthermore, while the removing members 149*a* and 149*b* are resilient hooks in this embodiment, they are not limited to this embodiment, but may be variable in their form.

When the dust cover 240 is mounted on the cleaner body 120, the guide ribs 242 guide the dust cover 240 so that the end of the first fence 123 and the end of the second fence 241 pressingly contact each other at their surfaces. Each of the guide ribs 242 protrude from an inside surface of the dust cover 240 adjacent to a side surface of the second fence 241 and include a first guide rib 243 and a second guide rib 244 that protrude from the second fence 241 inwardly and outwardly, respectively. The first guide rib 243 and the second guide rib 244 are on opposed sides, relative to each other, with respect to the second fence 241.

A plurality of first and second guide ribs 243 and 244 are formed. The respective first guide ribs 243 are arranged along an outer circumference of the second fence 241, spaced apart from each other by a predetermined distance. The respective second guide ribs 244 are arranged along an inner circumference of the second fence 241, spaced apart from each other by a predetermined distance. Due to this arrangement, the second guide ribs 244 perform an additional function to prevent the second fence 241 from bending toward the dust collecting chamber 125 when the vacuum cleaner is driven to generate a suction force.

The respective first and second guide ribs 243 and 244 are arranged in an alternating arrangement with respect to the second fence 241. Accordingly, when the dust cover 240 is mounted on the cleaner body 120, the two opposing sides of the first fence 123 are supported on an inner surface of the guide rib 242 alternately. The guide rib 242 and the second fence 241 correspond to the conventional receiving recess 143 (FIG. 1) in their function. Also, the plurality of guide ribs 242 are arranged apart from each other by a predetermined distance, easily adapting to the deformation of the first fence 123 that is molded from a synthetic resin. Since the first and second fences 241 pressingly contact each other, there is no need for the packing portion 160 (FIG. 1), which is adapted in the conventional vacuum cleaners to accommodate the deformation of the receiving recess 143 and the first fences 123.

The end of the guide ribs 242 is higher than that of the second fence 241. Accordingly, when the dust cover 240 is mounted on the cleaner body 120, the first fence 123 contacts the guide rib 242 prior to contacting the second fence 241 so that the guide rib 242 guides the second fence 241 into the proper mounting position as the dust cover 240 is mounted to the cleaner body 120.

Figure 5:
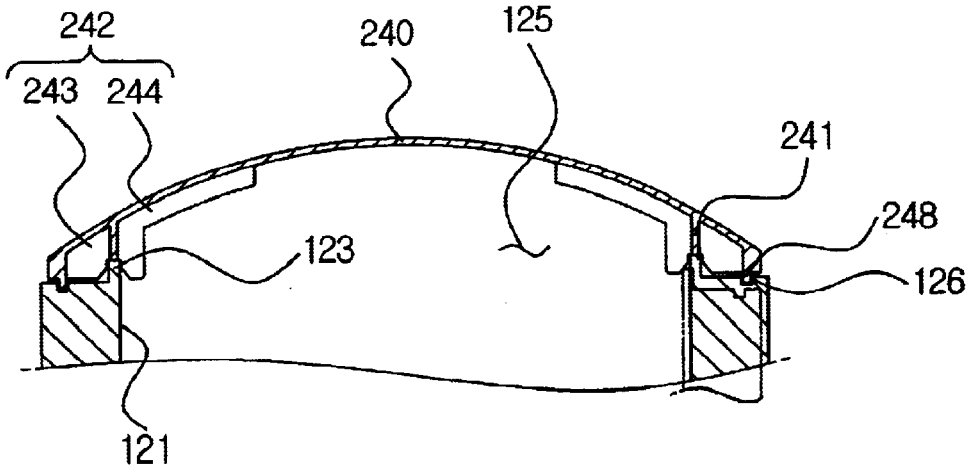
FIG. 5 is a cross-sectional view taken approximately along lines V—V of FIG. 3, showing a dust cover mounted on a cleaner body according to the present invention.

Meanwhile, the guide ribs 242 are provided with slanted surfaces 243*a* and 244*a* (FIG. 4) formed on upper ends thereof. The slanted surfaces 243*a* and 244*a* are formed such that the distance between the first and second guide ribs 243 and 244 becomes wider toward the upward portion of the guide ribs, when viewed from a vertical direction. Accordingly, as shown in FIG. 5, when the ends of the first and second fences 123 and 241 do not contact each other accurately, due to the presence of the slanted surfaces 243*a* and 244*a*, the end of the second fence 241 is smoothly, guided so as to contact the end of the first fence 123.

In addition to the first and second fences 123 and 241 and the guide rib as described above, the vacuum cleaner 200 uses various methods for improving the sealing efficiency of the dust cover 240. For example, like in the above embodiment, the dust cover 240 is provided with a rectangular protrusion 248 formed on opposing ends thereof, and the rectangular protrusion 248 is inserted into a hole shaped inserting recess 126, which is formed on the cleaner body 120, thereby improving the sealing efficiency of the dust cover 240.

Although the preferred embodiment of the present invention is herein described as an upright type vacuum cleaner by way of example, a canister type vacuum cleaner may also be employed.

According to the present invention, due to the presence of the guide ribs 242 protruding from the inner surface of the dust cover 240, the first fence 123, which protrudes along the end of the dust collecting chamber 125, and the second fence 241, which protrudes from the inner surface of the dust cover 240, pressingly contact each other at their ends.

Accordingly, unlike the conventional vacuum cleaners, there is no need for the packing portion 160, and this manufacturing cost is reduced.

Although the preferred embodiments of the present invention have been described, it is understood that the present invention should not be limited to these preferred embodiments, but various changes and modifications may be made by one skilled in the art so as to remain within the spirit and scope of the present invention as hereinafter claimed.

What is claimed is:

1. A dust cover sealing apparatus for a vacuum cleaner, comprising:

a first fence protruding from an edge of an open side of a dust collecting chamber which is disposed inside the vacuum cleaner, the first fence having a predetermined height; and a receiving portion formed on an inner surface of a dust cover that is mounted on a cleaner body for covering the open side of the dust collecting chamber, the receiving portion for receiving the first fence comprising:

a second fence protruding from the inner surface of the dust cover, with an end surface pressingly contacting an end surface of the first fence to seal the dust collecting chamber when the dust cover is mounted on the cleaner body; and a plurality of guide ribs protruding from an inner surface of the dust cover adjacent to a side of the second fence toward the first fence, for guiding the second fence so that ends of the first and second fences contact each other when the dust cover is mounted on the cleaner body.

2. The apparatus of claim 1, wherein the guide ribs comprise:

a plurality of first guide ribs arranged along an outer circumference of the second fence, spaced apart from each other by a predetermined distance; and a plurality of second guide ribs arranged along an inner circumference of the second fence, spaced apart from each other by a predetermined distance.

3. The apparatus of claim 2, wherein the first and second guide ribs are arranged in an alternating arrangement, on opposed sides relative to each other with respect to the second fence.

4. The apparatus of claim 2, wherein the first and second guide ribs have slanted surfaces formed on upper end thereof.

* * * * *